US006918783B2

(12) United States Patent
Endo et al.

(10) Patent No.: US 6,918,783 B2
(45) Date of Patent: Jul. 19, 2005

(54) CONNECTOR CAPABLE OF PREVENTING INCOMPLETE FITTING

(75) Inventors: Tomomi Endo, Shizuoka (JP); Atsushi Nishida, Aichi (JP); Yoshitaka Kashima, Aichi (JP); Masato Minakata, Aichi (JP); Keiichi Ito, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/771,287

(22) Filed: Feb. 5, 2004

(65) Prior Publication Data

US 2004/0185700 A1 Sep. 23, 2004

(30) Foreign Application Priority Data

Feb. 6, 2003 (JP) ..... P2003-029825

(51) Int. Cl.[7] ..... H01R 13/627
(52) U.S. Cl. ..... 439/352; 439/489
(58) Field of Search ..... 439/152, 489, 439/352, 353, 357, 358, 752

(56) References Cited

U.S. PATENT DOCUMENTS 5,605,472 A 2/1997 Sakai et al.
5,820,400 A 10/1998 Yamanashi et al.
6,241,547 B1 * 6/2001 Fukuda ..... 439/352
6,419,515 B1 * 7/2002 Okayasu ..... 439/358
6,572,400 B2 * 6/2003 Noguchi et al. ..... 439/489

FOREIGN PATENT DOCUMENTS

| | | |
|---|---|---|
| GB | 2 376 576 A | 12/2002 |
| JP | 8-31517 | 2/1996 |
| JP | 9-180818 | 7/1997 |

* cited by examiner

*Primary Examiner*—Thanh-Tam Le
(74) *Attorney, Agent, or Firm*—Finnegan, Henderson, Farabow, Garrett & Dunner, L.L.P.

(57) ABSTRACT

A first connector housing is provided with a flexible lock arm. A tubular fitting detector is fitted to an outer periphery of the first connector housing while being slidable thereon between a first position and a second position. A retainer is provided on the fitting detector, and adapted to be engaged with a first portion of the lock arm in a case where the fitting detector is placed at the first position, and engaged with a second portion of the lock arm in a case where the fitting detector is placed at the second position. A second connector housing is provided with a projection adapted to release the engagement between the retainer and the first portion of the lock arm in a case where the second connector housing is completely fitted with the first connector housing, so that the fitting detector is allowed to slide from the first position to the second position. A finger pad is provided on the fitting detector, and arranged such that an operator's finger is placeable thereon while being separated from at least the lock arm, during a fitting operation between the first connector housing and the second connector housing.

4 Claims, 8 Drawing Sheets

CONNECTOR CAPABLE OF PREVENTING INCOMPLETE FITTING

BACKGROUND OF THE INVENTION

The present invention relates to a connector capable of preventing incomplete fitting, and more particularly, to a connector which detects an incomplete fitting state between a pair of female connector housing and male connector housing, based on whether a fitting detector provided on one of the connector housings can slide up to a predetermined position when the connector housings are fitted with each other.

FIGS. 4 and 5 show a related-art connector 50 of such a type. A female connector housing 60 which is one of the connector housings constituting the connector 50 is provided with a fitting detector 70 which is fitted to the female connector housing 60 so as to surround an outer periphery thereof. The fitting detector 70 is formed with a retainer 71 in an upper part thereof.

The female connector housing 60 contains a plurality of female terminals 62 inside a main body 61 and is provided with a flexible lock arm 64 having a hole 63. Moreover, the female connector housing 60 comprises a front holder 66 which is fitted into the main body 61 by way of an O-ring 65.

Prior to a fitting operation with respect to a male connector housing 100, the retainer 71 of the fitting detector 70 is inserted into the hole 63 of the female connector housing 60 from the above. When a front end portion of the retainer 71 has come into contact with a front end of the hole 63, the front holder 66 of the female connector housing 60 is restricted to the initial position in which the front holder 66 protrudes from the fitting detector 70.

When the male connector housing 100 has started to be fitted with the female connector housing 60, a projection 101 of the male connector housing 100 is inserted from the below into the hole 63 of the female connector housing 60 thereby to push up the retainer 71 of the fitting detector 70 out of the hole 63, whereby restriction of the fitting detector 70 with respect to the female connector housing 60 will be released.

After the restriction with respect to the female connector housing 60 has been released, the fitting detector 70 slides relative to the female connector housing 60 to be displaced up to a position indicating the complete fitting. Then, the retainer 71 rides over the flexible lock arm 64 of the female connector housing 60 and locked to the flexible lock arm 64 with a feel of click thereby to be restrained from the sliding movement. With this motion, the complete fitting state of the male connector housing 100 with the female connector housing 60 can be detected, and male terminals contained in the male connector housing 100 will be brought into electrical contact with the male terminals 62.

However, the connector 50 has had a problem that when the fitting detector 70 slides relative to the female connector housing 60, the female connector housing 60 may be pressed with a hand or fingers of an operator who is conducting the fitting work, and in some cases, the fitting detector 70 may not slide relative to the female connector housing 60, resulting in the incomplete fitting state.

SUMMARY OF THE INVENTION

It is therefore an object of the invention to provide a connector capable of attaining reliable engagement between connector housings without inducing a working error.

In order to achieve the above object, according to the invention, there is provided a connector, comprising:

a first connector housing, provided with a flexible lock arm;

a tubular fitting detector, fitted to an outer periphery of the first connector housing while being slidable thereon between a first position and a second position;

a retainer, provided on the fitting detector, and adapted to be engaged with a first portion of the lock arm in a case where the fitting detector is placed at the first position, and engaged with a second portion of the lock arm in a case where the fitting detector is placed at the second position;

a second connector housing, provided with a projection adapted to release the engagement between the retainer and the first portion of the lock arm in a case where the second connector housing is completely fitted with the first connector housing, so that the fitting detector is allowed to slide from the first position to the second position; and a finger pad, provided on the fitting detector, and arranged such that an operator's finger is placeable thereon while being separated from at least the lock arm, during a fitting operation between the first connector housing and the second connector housing.

In such a configuration, when the second connector housing is fitted with the first connector housing, the operator's finger will not press the first connector housing because the operator conducts the fitting operation with his/her finger held on the finger pad of the fitting detector.

Therefore, because the first connector housing will not be pressed with the finger of the operator who is doing the fitting operation, an incomplete fitting state of the first connector housing with the second connector housing due to the fact that the fitting detector becomes unable to slide relative to the first connector housing will be avoided. As a result, the mutual engagement between the connector housings can be reliably conducted without inducing a working error.

Preferably, an upper face of the finger pad on which the operator's finger is placed is situated upper than an upper face of the lock arm.

In such a configuration, the finger of the operator is securely prevented from being brought into contact with the first connector housing during the fitting operation. As a result, the mutual engagement between the connector housings can be reliably conducted without inducing a working error.

Preferably, the fitting detector comprises a pair of side walls and a bridge member connecting the side walls while preventing the operator's finger from being brought into contact with the first connector housing.

In such a configuration, since the operator conducts the fitting operation with his/her finger held on the finger pad and the bridge member, the operator who is doing the fitting work will not press the first connector housing with his/her finger. Such a drawback that the fitting detector becomes unable to slide relative to the first connector housing will be avoided. As a result, the mutual engagement between the connector housings can be more reliably conducted without inducing a working error.

Here, it is preferable that the bridge member comprises a guide projection which is usually brought into contact with the first connector housing.

In such a configuration, when the fitting detector slides relative to the first connector housing, the first connector housing moves while being guided by the guide projection.

Therefore, the first connector housing can be reliably displaced without striking the bridge member held by the operator's finger. As the results, such a drawback that the fitting detector becomes unable to slide relative to the first connector housing will be avoided, and the mutual engagement between the connector housings can be more reliably conducted without inducing a working error.

Here, it is further preferable that the guide projection is extended from the bridge member in a sliding direction of the fitting detector.

In such a configuration, since the guide projection can be produced by adding a slight change to a mold for producing the fitting detector, productivity can be enhanced without incurring an increase in number of molding processes.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

One preferred embodiment of the invention will be described below in detail with reference to the accompanying drawings.

Figure 1:
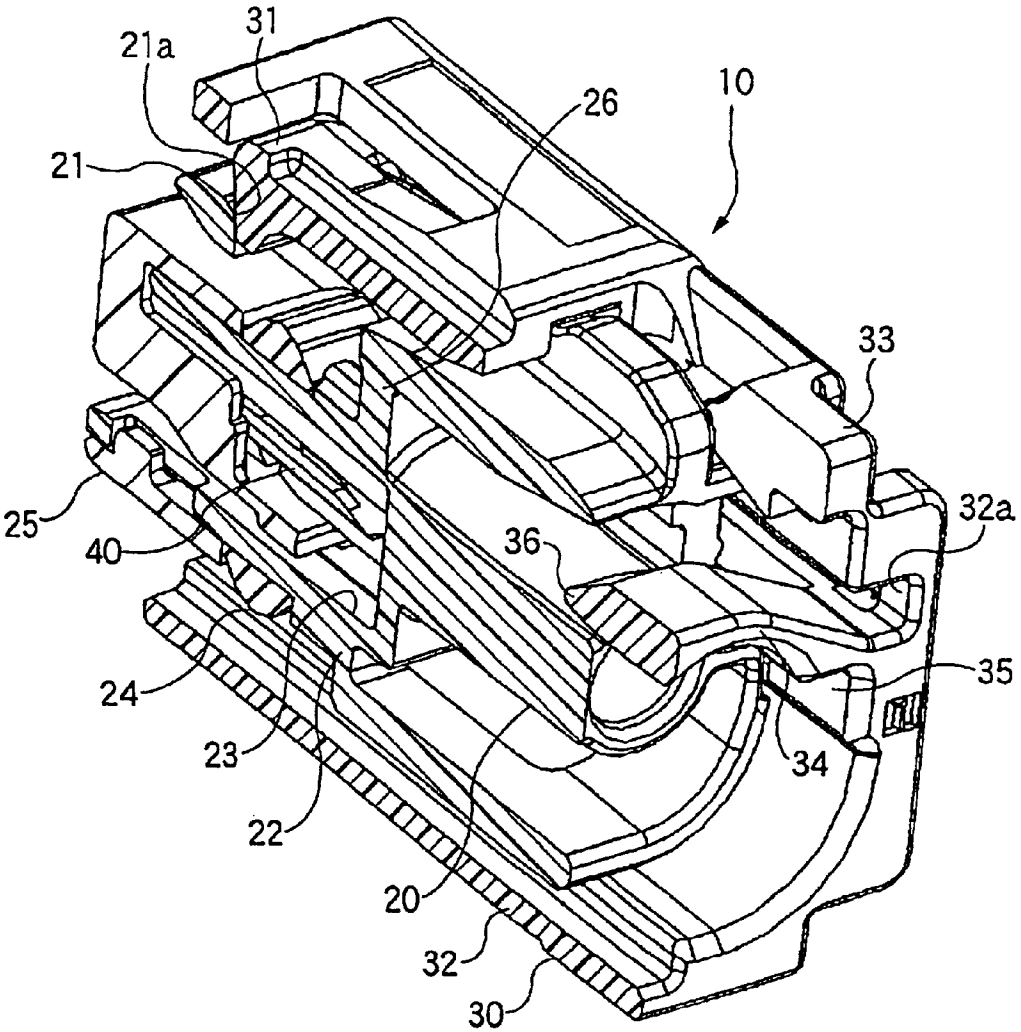
FIG. 1 is a sectional perspective view showing a connector according to one embodiment of the invention.
Figure 6:
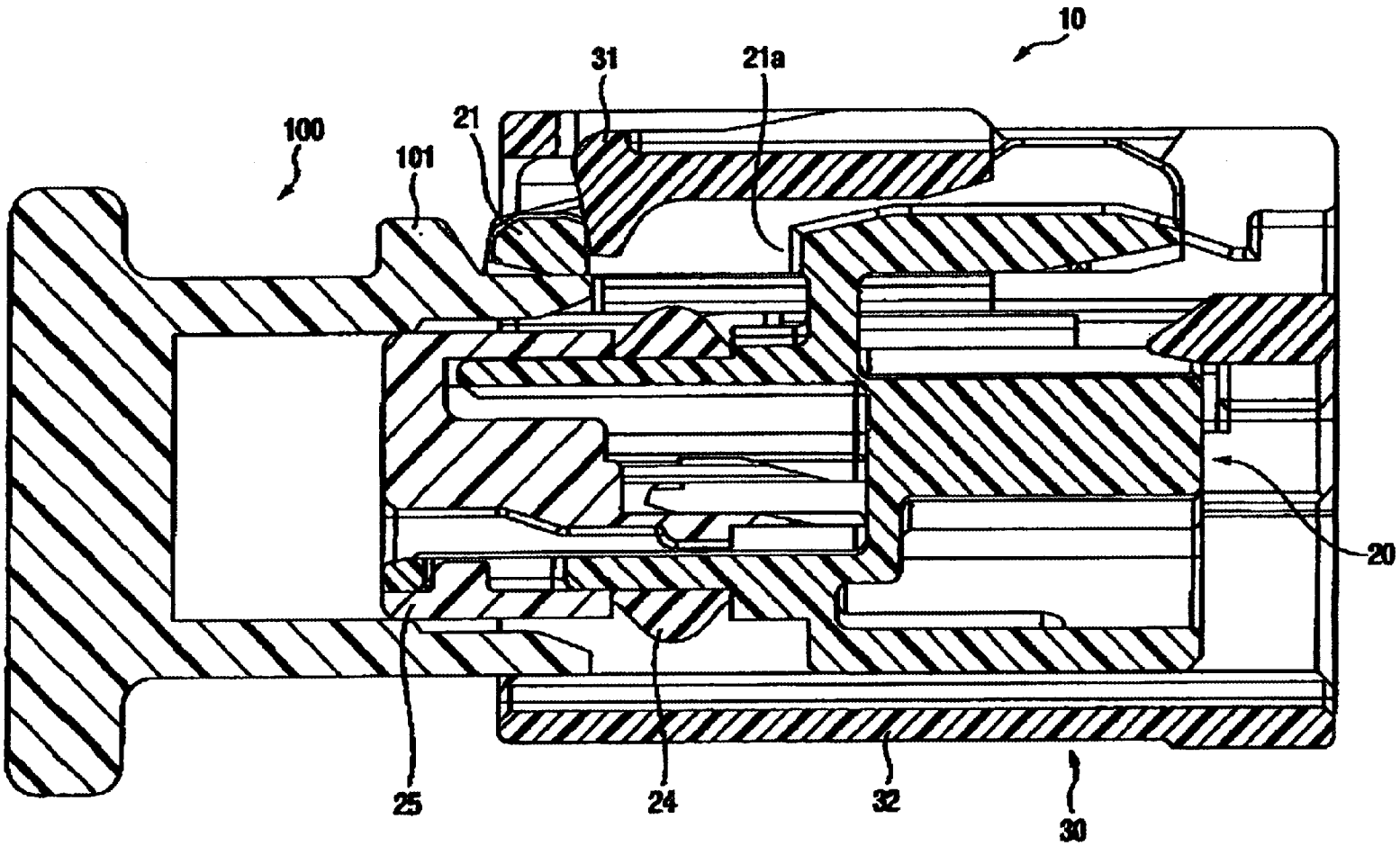

As showing in FIG. 1, a connector 10 in this embodiment comprises a female connector housing 20 which is a connector housing having a flexible lock arm 21, and a fitting detector 30 in a substantially tubular shape fitted around the female connector housing 20 slidably in a fitting direction. The fitting detector 30 is provided with a retainer 31 adapted to be engaged with the flexible lock arm 21. A male connector housing 100, shown in FIG. 6, is adapted to be fitted to the female connector housing 20.

Figure 2:
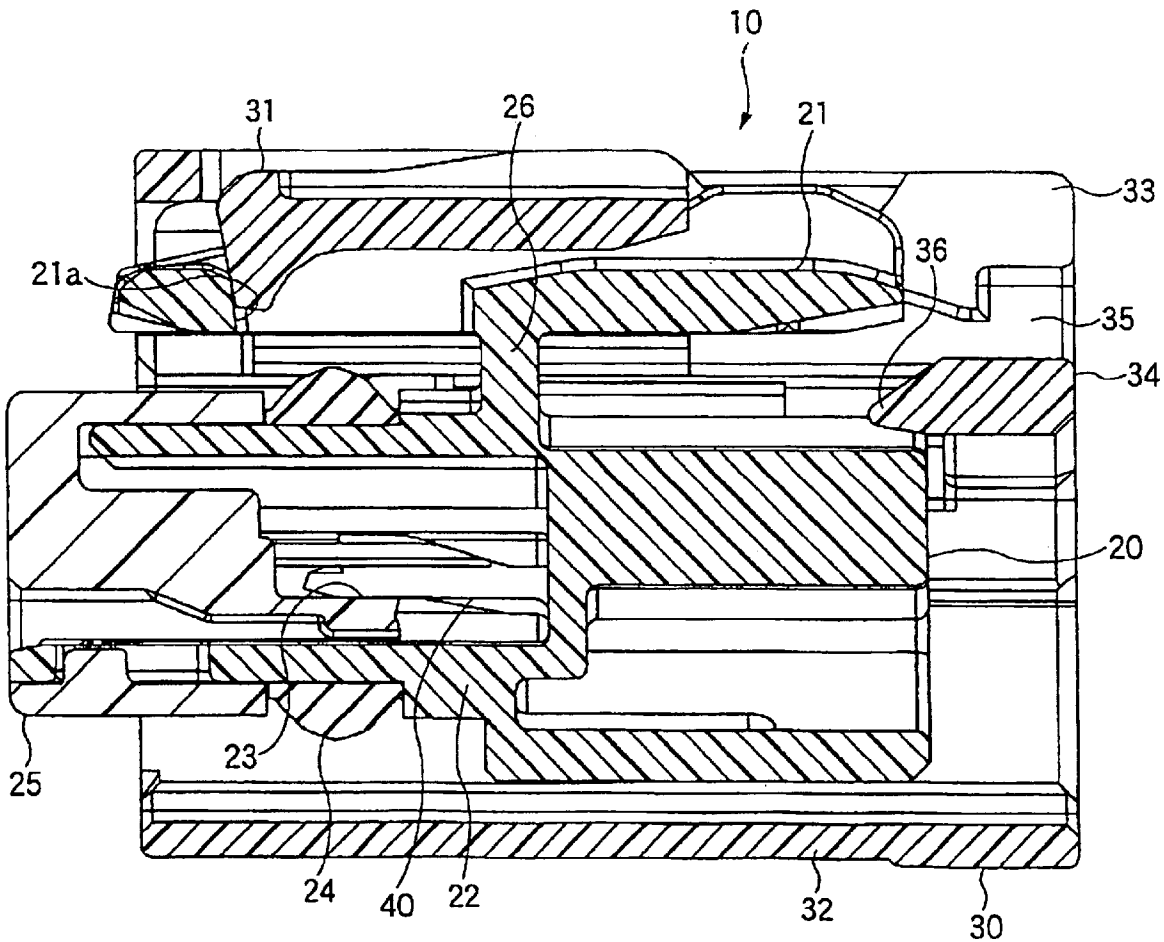
FIG. 2 is a sectional view of the connector of the invention.

As shown in FIG. 2, the female connector housing 20 includes a housing body 22 in a substantially cylindrical shape in which terminal chambers 23 for containing and holding female terminals 40 are formed. A front holder 25 is fitted into the housing body 22 by way of an O-ring 24 from the front.

The flexible lock arm 21 is arranged on an upper face of the housing body 22, and extends along a fitting direction of the housing body 22 in forward and backward directions from a top end of a support post 26 which is provided uprightly at a center of the upper face of the housing body 22. The flexible lock arm 21 is movable in a seesaw manner about the support post 26 as a fulcrum.

The female connector housing 20 is provided with rib-shaped guide ridges (not shown) which are projected from an outer face thereof and extending in the fitting direction.

Figure 3:
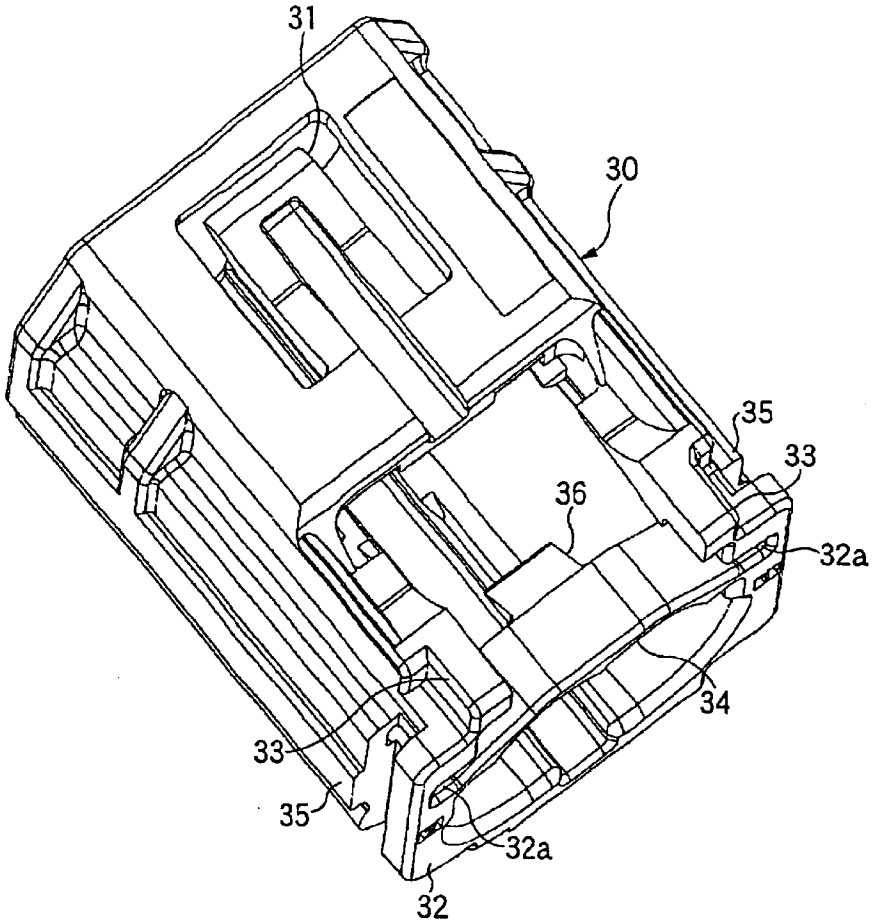
FIG. 3 is a perspective view showing an external appearance of a fitting detector in the connector of the invention.
Figure 4:
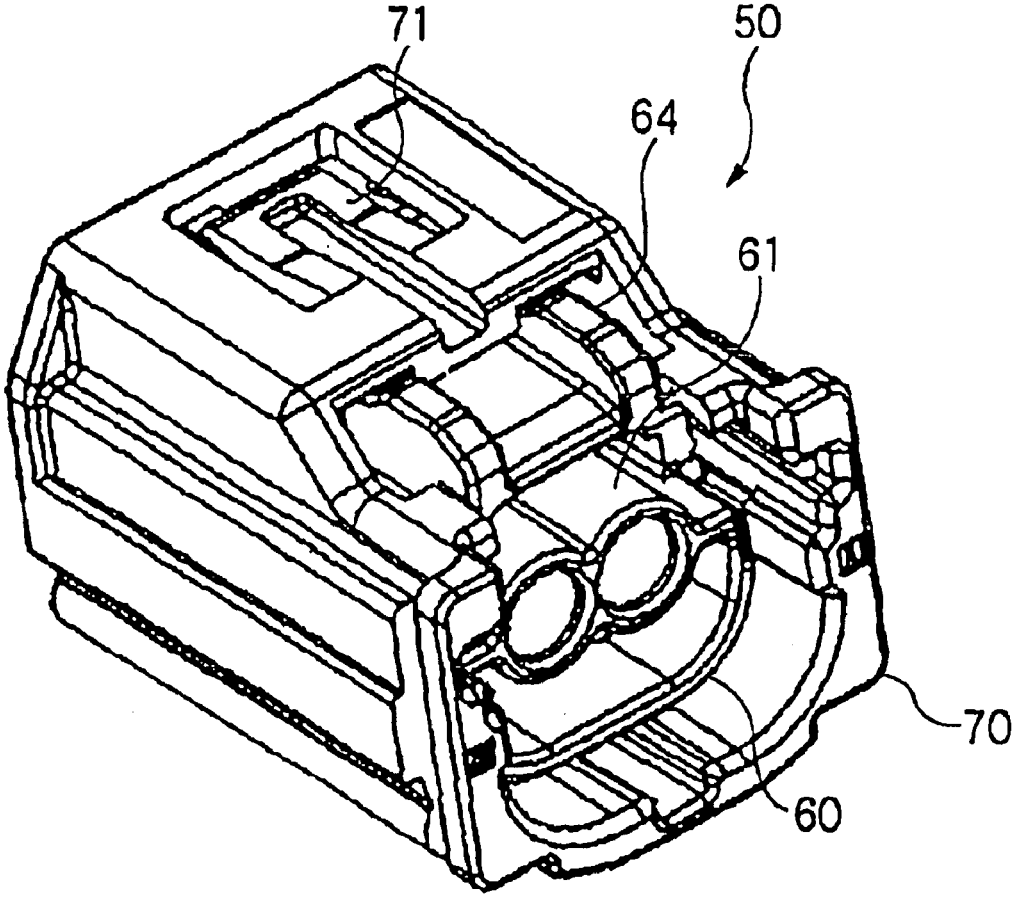
FIG. 4 is a perspective view showing an external appearance of a related-art connector.
Figure 5:
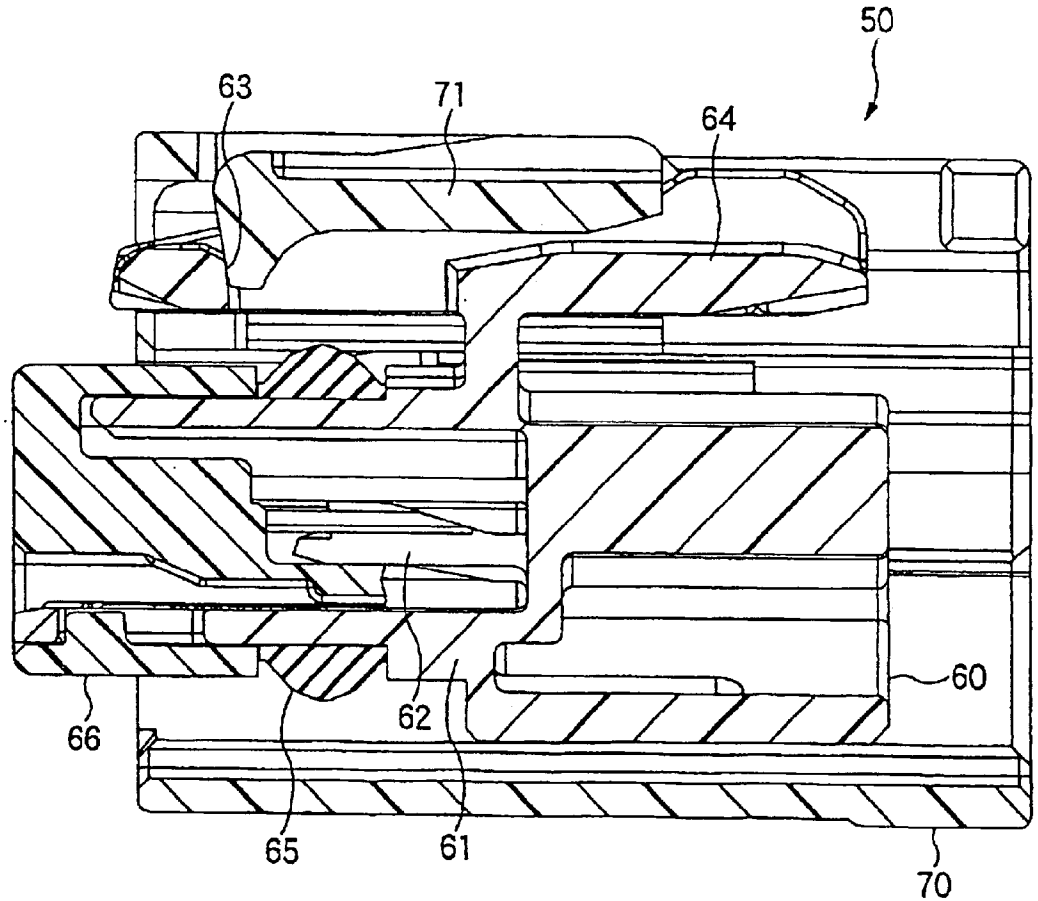
FIG. 5 is a sectional view of the related-art connector.

As shown in FIG. 3, the fitting detector 30 has a main body 32 in a substantially tubular shape which is fitted to an outer periphery of the female connector housing 20 to surround the housing body 22. The retainer 31 is provided in the upper part of the main body 32 so as to be flexed in up and down directions in FIG. 1. The main body 32 is formed with grooves 32*a* which receive the guide ridges of the female connector housing 20, so that the female connector housing 20 is supported while being slidably in the fitting direction.

A pair of pillar-shaped finger pads 33 and a protective bridge portion 34 are formed in a rear end of the main body 32 in the fitting direction. The finger pads 33 are formed in the upper part of the rear end of the main body 32 so as to protrude beyond the flexible lock arm 21. Accordingly, an operator who is doing a fitting work can conduct the fitting work with his fingers held on the finger pads 33 and will not directly press the female connector housing 20.

Because this will prevent the female connector housing 20 from being pressed with the fingers, such a drawback that the fitting detector becomes unable to slide relative to the female connector housing 20, and the engagement between the male connector housing 100 and the female connector housing come into an incomplete fitting state will be avoided. As the results, the mutual engagement between the connector housings can be reliably conducted.

The protective bridge portion 34 is formed in the rear end of the main body 32 so as to bridge both the side plates 35 constituting a tubular shape of the main body 32. The protective bridge portion 34 has a curved shape corresponding to an outer profile of the female connector housing 20, and is provided on the end part of the female connector housing 20 in the initial position. Accordingly, the operator who is doing the fitting work can conduct the fitting work with his fingers held on the protective bridge portion 34 and will not directly press the female connector housing 20.

Moreover, a guide projection 36 is provided so as to project from a front end of the protective bridge portion 34 relative to the fitting direction. The guide projection 36 is adapted to come into contact with an outer face of the female connector housing 20 prior to the fitting operation, and adapted to slide along the outer face of the female connector housing 20 during the fitting operation to guide the movement of the fitting detector 30.

Therefore, even though the fitting detector 30 has been flexed with a large load, the female connector housing 20 can be reliably moved without striking the protective bridge portion 34. As the results, incomplete fitting between the male connector housing 100 and the female connector housing 20 due to the fact that the fitting detector 30 becomes unable to slide relative to the female connector housing 20 will be avoided, and the mutual engagement between the connector housings can be reliably conducted.

In the connector 10 having such a structure, prior to the fitting operation while the female connector housing 20 is kept in the initial position, the retainer 31 of the fitting detector 30 is inserted into the hole 21*a* of the flexible lock arm 21 in the female connector housing 20 from the above to be engaged with the hole 21*a*.

Figure 7:
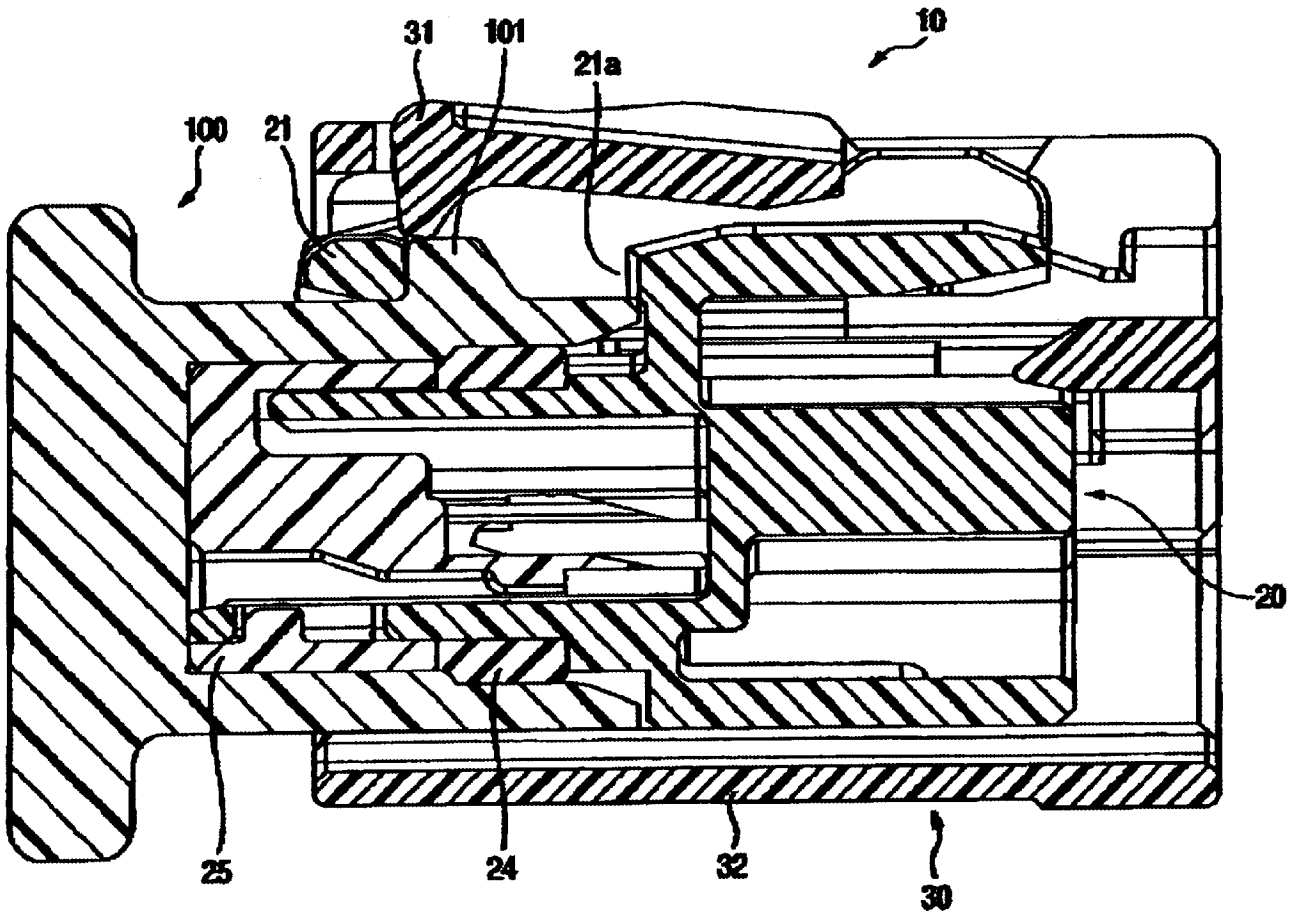

Then, the male connector housing 100 starts to be fitted with the female connector housing 20, and a projection 101 of the male connector housing 100 is inserted into the hole 21*a* from the below of the flexible lock arm 21, as shown in FIG. 7. With this motion, the retainer 31 which has been engaged in the hole 21*a* is pushed out thereby to release the restriction for keeping the fitting detector 30 in the initial position, and the fitting detector 30 is put into a state allowable to move in the fitting direction.

Figure 8:
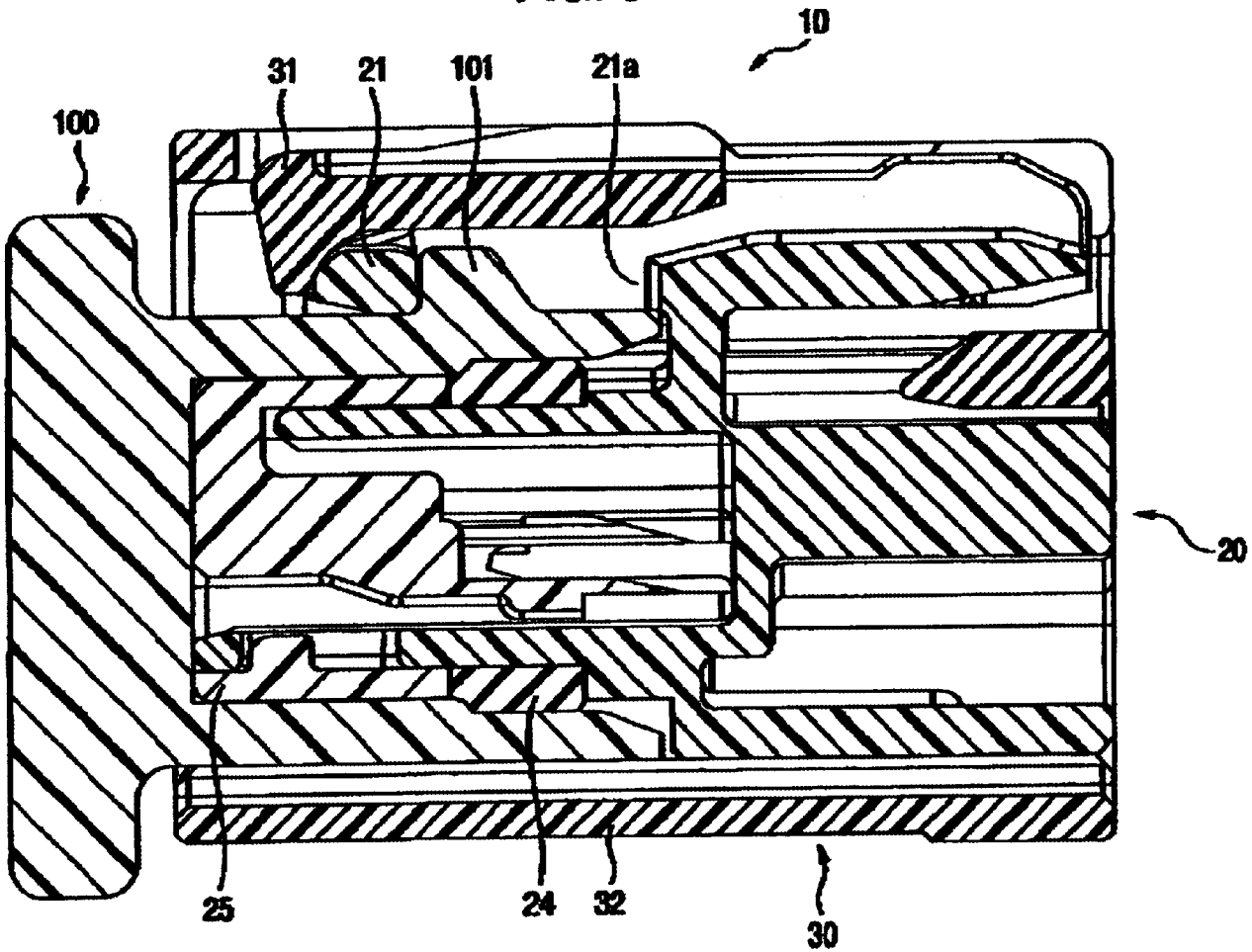

After the fitting detector 30 has been moved by the operator to a predetermined position provided in the forward area of the connector 10 as shown in FIG. 8, the retainer 31 of the fitting detector 30 rides over the flexible lock arm 21, and is dropped outside of a forward end portion of the flexible lock arm 21 in a manner of snap-action, thereby to be engaged with the forward end portion of the flexible lock arm 21.

As the results, the sliding movement of the fitting detector 30 will be stopped and the complete fitting state can be detected, permitting the female terminals 40 contained in the female connector housing 20 to be electrically connected to the male terminals contained in the male connector housing 100.

As described above, when the male connector housing 100 is engaged with the female connector housing 20 which is provided with the fitting detector 30 therearound, the operator conducts the fitting work with his fingers held on the finger pads 22 and the protective bridge portion 34 of the fitting detector 30. Moreover, when the fitting detector 30 slides relative to the female connector housing 20, the female connector housing 20 moves while being supported by the guide projection 36 which is extended from the protective bridge portion 34 in the fitting direction.

Therefore, the operator who is doing the fitting work will not press the female connector housing 20, because he conducts the fitting work with his fingers held on the finger pads 33 and the protective bridge portion 34. Further, when the female connector housing 20 slides relative to the fitting detector 30, the female connector housing moves while it is supported by the guide projection 36, and can be reliably moved without striking the protective bridge portion 34.

As the results, the mutual engagement between the connector housings can be reliably conducted, and the fitting work of the connector housings with each other can be reliably conducted without inducing a working error. Besides, since the guide projection 36 can be provided by applying a slight change to a mold for producing the fitting detector 30, productivity can be enhanced without incurring an increase in number of molding processes.

It is to be noted that the connector according to the invention is not limited to the above described embodiment, but an appropriate modification, improvement and so on can be made within a scope of the appended claims.

For example, a shape of the finger pad 33 is not limited to the shape as illustrated in the drawings, but may be in a rod shape, a conical shape or a pyramidal shape.

Moreover, a shape of the protective bridge portion 34 is not limited to the shape as illustrated in the drawings, but may be, for example, in such a shape as having a flat-face in its upper face and a curved face in its lower face.

Further, a shape of the guide projection 36 formed on the protective bridge portion 34 is not limited to the shape as illustrated in the drawings, but the guide projection may be shaped by projecting the entire width of the protective bridge portion 34.

What is claimed is:

1. A connector, comprising:

a first connector housing, provided with a flexible lock arm;

a tubular fitting detector, fitted to an outer periphery of the first connector housing while being slidable thereon between a first position and a second position;

a retainer, provided on the fitting detector, and adapted to be engaged with a first portion of the lock arm in a case where the fitting detector is placed at the first position, and engaged with a second portion of the lock arm in a case where the fitting detector is placed at the second position;

a second connector housing, provided with a projection adapted to release the engagement between the retainer and the first portion of the lock arm in a case where the second connector housing is completely fitted with the first connector housing, so that the fitting detector is allowed to slide from the first position to the second position;

a finger pad, provided on the fitting detector, and arranged such that an operator's finger is placeable thereon while being separated from at least the lock arm, during a fitting operation between the first connector housing and the second connector housing;

wherein the fitting detector comprises a pair of side walls and a bridge member connecting the side walls while preventing the operator's finger from being brought into contact with the first connector housing; and wherein the finger pads and the bridge member are formed on the same end of the fitting detector relative to the first connector housing.

2. The connector as set forth in claim 1, wherein an upper face of the finger pad on which the operator's finger is placed is situated upper than an upper face of the lock arm.

3. The connector as set forth in claim 1, wherein the bridge member comprises a guide projection which is usually brought into contact with the first connector housing.

4. The connector as set forth in claim 3, wherein the guide projection is extended from the bridge member in a sliding direction of the fitting detector.

* * * * *

UNITED STATES PATENT AND TRADEMARK OFFICE

CERTIFICATE OF CORRECTION

PATENT NO. : 6,918,783 B2
DATED : July 19, 2005
INVENTOR(S) : Tomomi Endo et al.

It is certified that error appears in the above-identified patent and that said Letters Patent is hereby corrected as shown below:

Column 3,
Line 30, delete “and”.
Line 31, delete “.” and add -- ; --.
Line 32, add -- Fig. 6 is a sectional view of a male connector housing; --.
Line 33, add -- Fig. 7 is a sectional view of a male connector housing; and --.
Line 34, add -- Fig. 8 is a sectional view of the connector housing of the invention. --.

Signed and Sealed this

Fourth Day of October, 2005

JON W. DUDAS
*Director of the United States Patent and Trademark Office*